US012286760B2

(12) United States Patent
Impero

(10) Patent No.: US 12,286,760 B2
(45) Date of Patent: Apr. 29, 2025

(54) MODULE OF A ROAD SAFETY BARRIER AND A METHOD FOR REALISING THE MODULE

(71) Applicant: Pasquale Impero, Acerra (IT)

(72) Inventor: Pasquale Impero, Acerra (IT)

(73) Assignee: Pasquale Impero (IT)

( * ) Notice: Subject to any disclaimer, the term of this patent is extended or adjusted under 35 U.S.C. 154(b) by 220 days.

(21) Appl. No.: 17/927,224

(22) PCT Filed: May 31, 2021

(86) PCT No.: PCT/IB2021/054754
§ 371 (c)(1),
(2) Date: Nov. 22, 2022

(87) PCT Pub. No.: WO2021/240482
PCT Pub. Date: Dec. 2, 2021

(65) Prior Publication Data

US 2023/0313474 A1 Oct. 5, 2023

(30) Foreign Application Priority Data

May 29, 2020 (IT) ..... 102020000012877

(51) Int. Cl.
*E01F 15/04* (2006.01)

(52) U.S. Cl.
CPC ..... *E01F 15/043* (2013.01)

(58) Field of Classification Search
CPC ... E01F 15/04; E01F 15/0407; E01F 15/0423; E01F 15/043; E04H 17/1413; E04H 17/1417; E04H 17/1473
USPC ..... 256/13.1
See application file for complete search history.

(56) References Cited

U.S. PATENT DOCUMENTS

| | | | | |
|---|---|---|---|---|
| 8,282,082 | B2 * | 10/2012 | An | E01F 15/025 256/13.1 |
| 9,725,857 | B2 * | 8/2017 | Cho | E01F 15/043 |
| 10,895,048 | B2 * | 1/2021 | Gremling | E01F 15/043 |
| 11,879,218 | B2 * | 1/2024 | Impero | E01F 15/0407 |
| 2023/0203767 | A1 * | 6/2023 | Impero | E01F 15/043 404/6 |

FOREIGN PATENT DOCUMENTS

| | | | | |
|---|---|---|---|---|
| DE | 19536915 | A1 * | 2/1997 | E01F 15/043 |
| DE | 202012003240 | U1 | 5/2012 | |
| DE | 2013107462 | A1 | 1/2015 | |
| DE | 102016119838 | A1 * | 4/2018 | E01F 15/0438 |

* cited by examiner

*Primary Examiner* — Josh Skroupa
(74) *Attorney, Agent, or Firm* — Endurance Law Group PLC

(57) ABSTRACT

A module of road safety barrier for contacting and redirecting an errant vehicle includes a first beam, a second beam, and uprights that support them. The first beam has a first longitudinal part projecting laterally with respect to the uprights and also has a second longitudinal part projecting laterally with respect to the uprights, on the opposite side of the uprights with respect to the first longitudinal part. The first longitudinal part and the second longitudinal part are each joined to both of the uprights by means of permanent joints and are joined to one another by welds or brazing so as to form an internally hollow beam with longitudinal slots. In manufacturing, the whole module is galvanized.

15 Claims, 18 Drawing Sheets

MODULE OF A ROAD SAFETY BARRIER AND A METHOD FOR REALISING THE MODULE

FIELD OF THE INVENTION

The present invention relates to the technical sector relating to road safety systems used as passive containing elements for redirecting errant vehicles, in this way preventing the vehicles from invading the opposite carriageway or exiting the carriageway.

DESCRIPTION OF THE PRIOR ART

In particular, the present invention concerns a module of a road safety barrier, preferably used as a central barrier, i.e. installed between two carriageways. The invention also relates to the method for realising the module.

Road safety systems for errant vehicles comprise safety barriers, terminals, transitions, openable passages and shock absorbers, as described in the EN 1317-1:2010 standard. The road safety barrier of the invention is preferably central, or a central reservation, i.e. installed between two carriageways.

The road safety barriers, in the following simply termed "barriers", are located by the side of the carriageway and extend longitudinally to contain an errant vehicle along a portion of road. A first type of road barrier at present known is the one commonly known by the term "guardrail". Examples are illustrated in European patent application EP 2584096 A1 and in international application WO 2009090681 A1. The barriers comprise a series of uprights fixed in the ground, for example fixed to pins or lodged in the ground at a certain distance from one another, and beams or corrugated tapes which are fixed to the uprights in a longitudinal direction in such a way as to be consecutive to one another. The beams are fixed to the adjacent beams so as to form a continuous front to contain and redirect errant vehicles.

The beams are usually made of a metal material, such as for example aluminium or galvanized steel, and are designed so as to absorb, by deforming, an eventual impact caused by an errant vehicle that strikes against a guardrail. The beams are usually obtained by appropriately profiling pieces of metal sheet.

The installation of a like barrier type requires many operations at the place of installation with the consequent drawbacks in operational management and working times. The response to impacts on the barrier is further conditioned by the accuracy of the installation; it is clear how variations or errors in installation are more probable than when the main operations take place in the factory.

Another type of barrier commonly used is constituted by consecutively-arranged blocks; when the blocks are made of concrete this barrier is often known as the "New Jersey". In general, although numerous variants of blocks have been developed, the positioning and/or displacement of this type of barrier is simpler, while often requiring special tools.

Though New Jersey barriers have no significant discontinuities, nor protruding parts, they are characterised by very high rigidity and by a low capacity of absorbance of the impact of an errant vehicle. Therefore, the risks of damage and injury for persons are very high.

There is therefore a perceived need for a barrier that is easy to install and repair and which at the same time guarantees good absorbance of impacts while limiting discontinuity as much as possible.

This need is still more keenly perceived when the barriers are placed at the central part of dual-carriageway roads, such as for example highways and motorways. The central barrier must guarantee a symmetrical behaviour, i.e. identical on both carriageways, and the impact of a carriageway must have a limited impact with respect to the other carriageway, i.e. the barrier must be prevented from bellying out or excessively deforming on the other side.

SUMMARY OF THE INVENTION

The aim of the present invention is to obviate some of the drawbacks of the prior-art solutions.

A first aim of the present invention is to provide a modular barrier that is easy and rapid to install.

A second aim of the invention is to improve the continuity of the barrier and the behaviour thereof with regard to impacts, in particular by improving the response of the longitudinal elements in interaction with the uprights.

A still further aim is to provide a module which guarantees high levels of containment with a compact structure and which can operate on both sides in an equivalent manner.

These and other aims, which will be obvious to the expert in the sector from a reading of the following text, are attained with a module of a road safety barrier for contacting and redirecting an errant vehicle according to claim 1 and also with a method for installing a module of a road safety barrier according to claim 10.

In accordance with the teachings of the present document, the module of the road safety barrier for contacting and redirecting an errant vehicle comprises a first beam, a second beam and uprights that support them.

As in the prior art, the first beam comprises a first longitudinal part which projects laterally with respect to the uprights. The first beam advantageously also comprises a second longitudinal part which projects laterally with respect to the uprights, on the opposite side of the uprights with respect to the first longitudinal part.

The first longitudinal part and the second longitudinal part are both joined to the first upright and to the second upright by means of joints of a permanent type and are joined to each other so as to form an internally hollow beam with welds or brazing, longitudinally spaced so as to form longitudinal slots.

The above described characteristics enable realising a compact module, which has a first beam having an excellent response to torsion, although with the first longitudinal part and the second longitudinal part having good deformability characteristics, and which can be easily installed.

The description that follows also illustrates a method for realising a module as described in the foregoing.

BRIEF DESCRIPTION OF THE DRAWINGS

Specific embodiments of the invention will be described in the following part of the present description, according to what is set down in the claims and with the aid of the accompanying drawings, in which:

Figures 9, 9A, 9B, 9C, 9D, 9E, 9F:
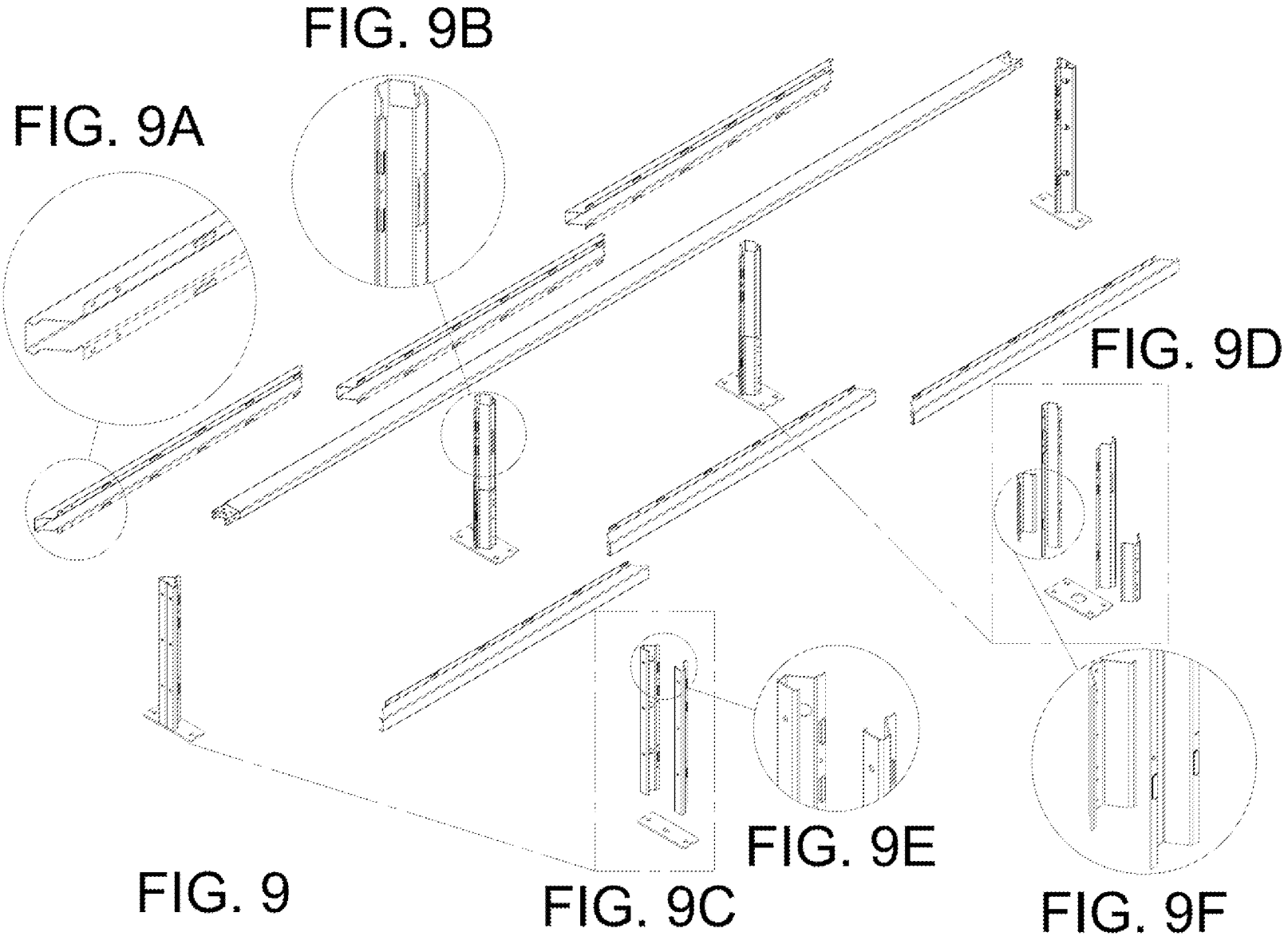
FIG. 9 is an exploded view of an embodiment of a module of a barrier according to the invention.
FIGS. 9A and 9B are enlarged views of the indicated areas in FIG. 9, FIGS. 9C and 9D are exploded view of the indicated elements in FIG. 9, and FIGS. 9E and 9F are enlarged views of the indicated areas in FIGS. 9C and 9D respectively.
Figure 11:
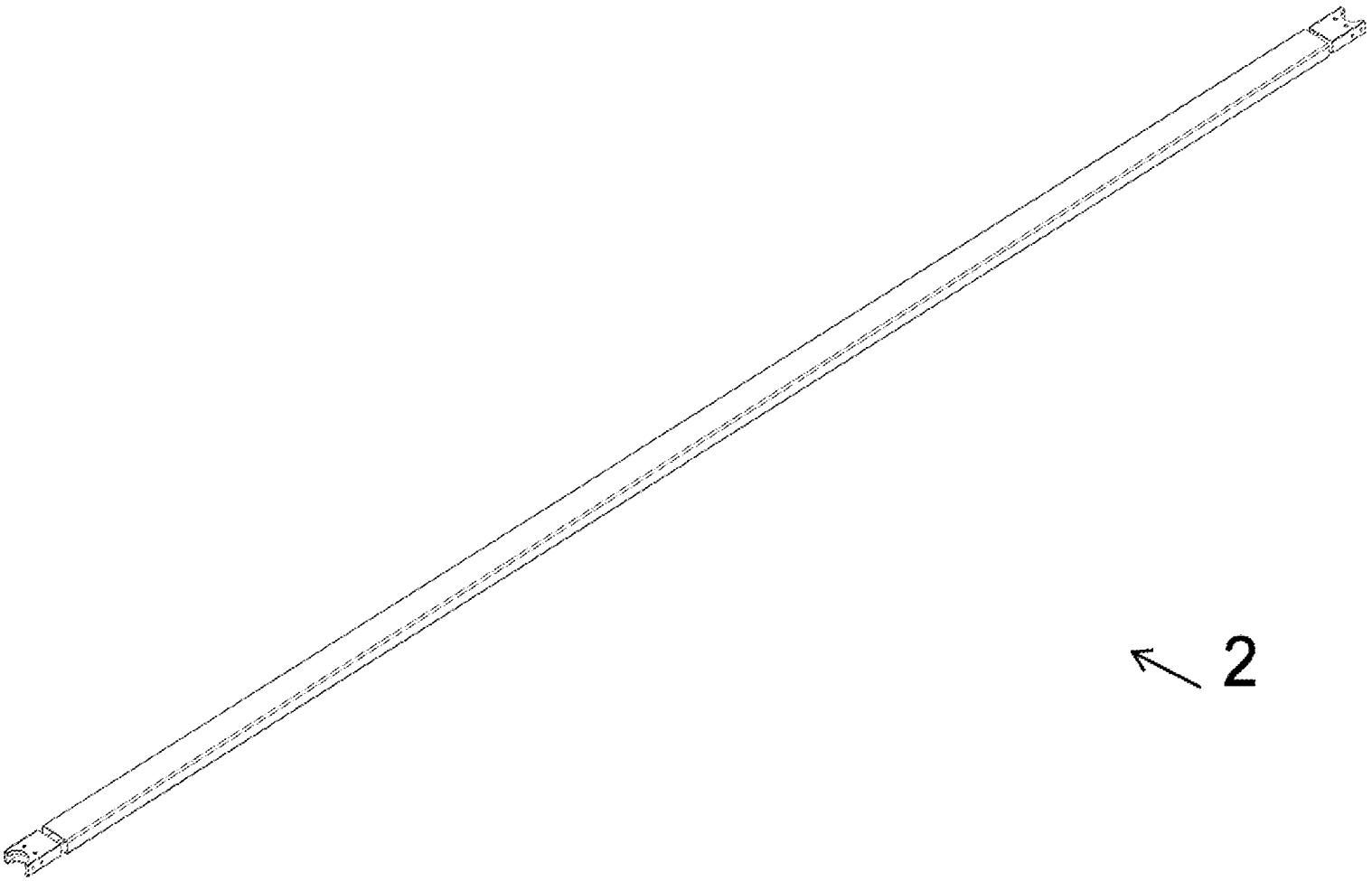
Figure 12:
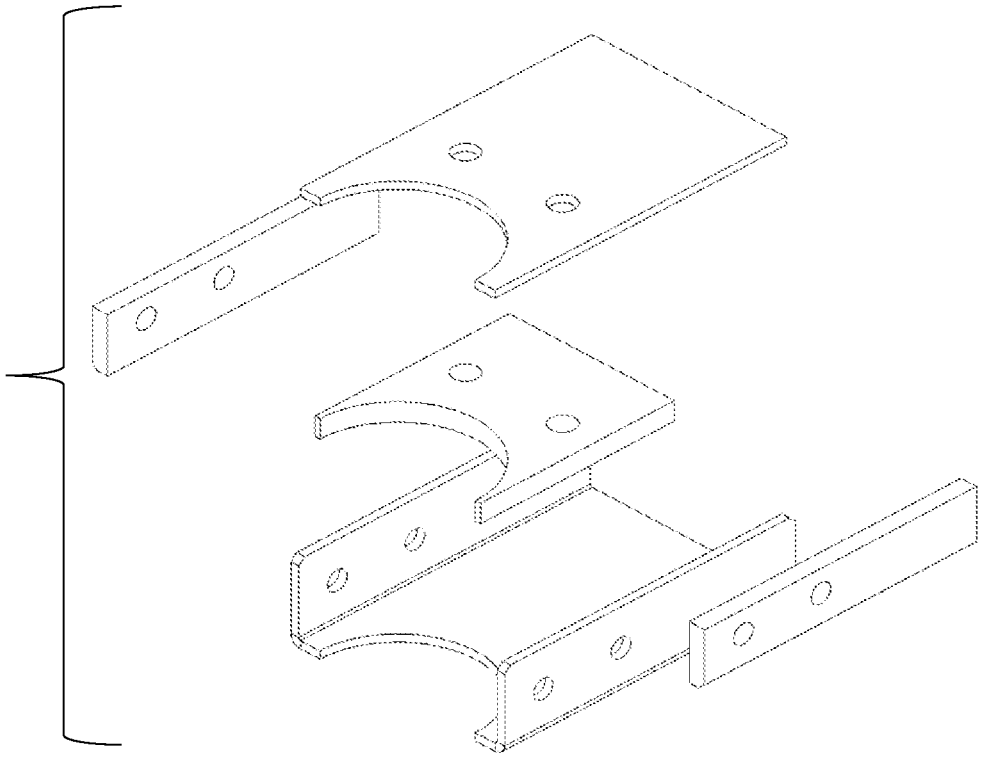
Figure 13:
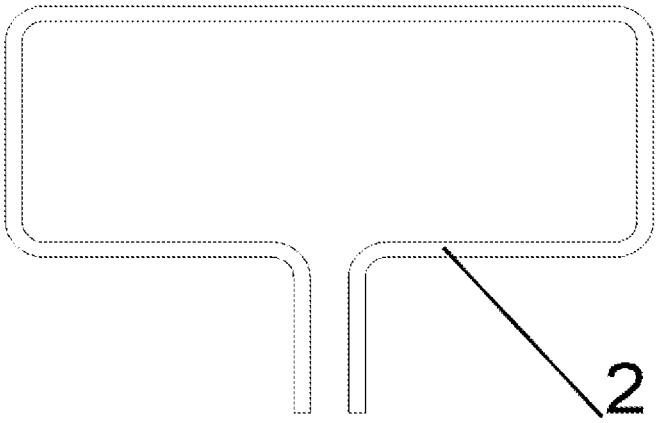

the exploded axonometric view of FIG. 11, the exploded axonometric view of FIG. 12 and the section view of FIG. 13, without background context, detail the element of FIG. 9, unexploded.

Figure 14:
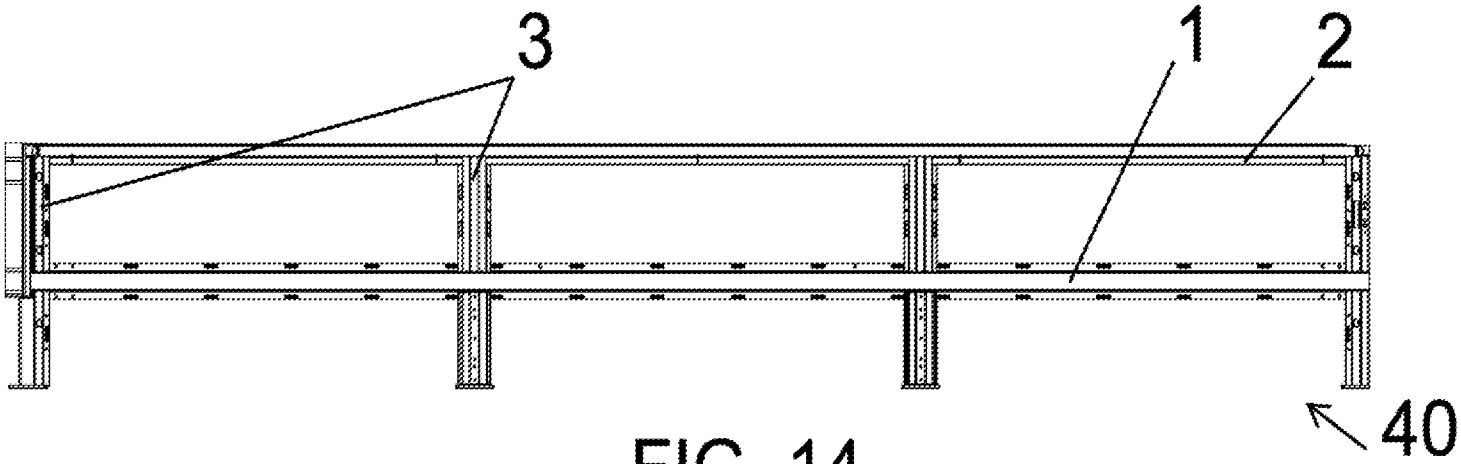
Figure 15:
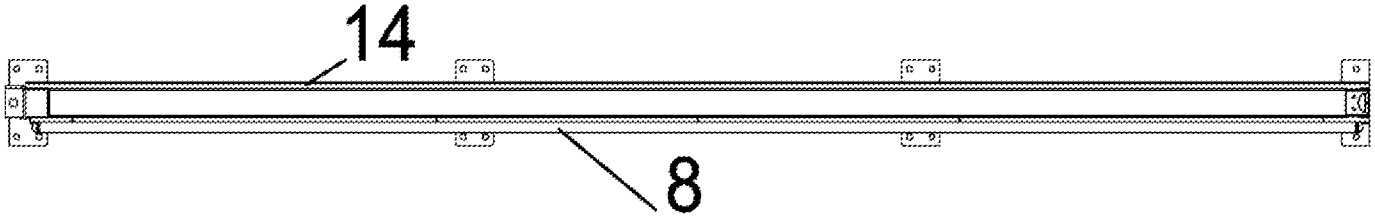
Figure 16:
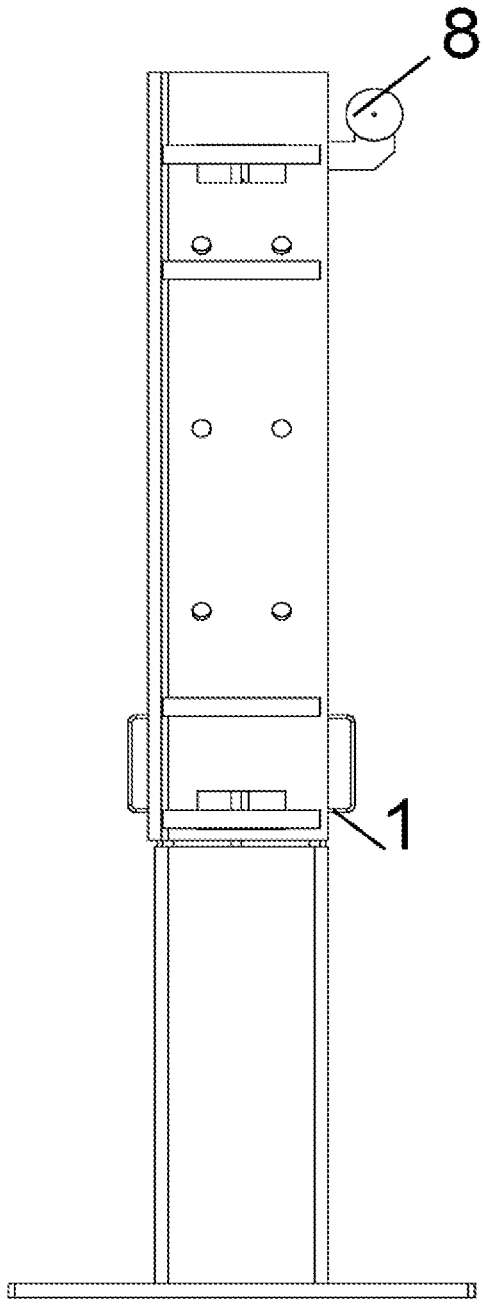
Figure 17:
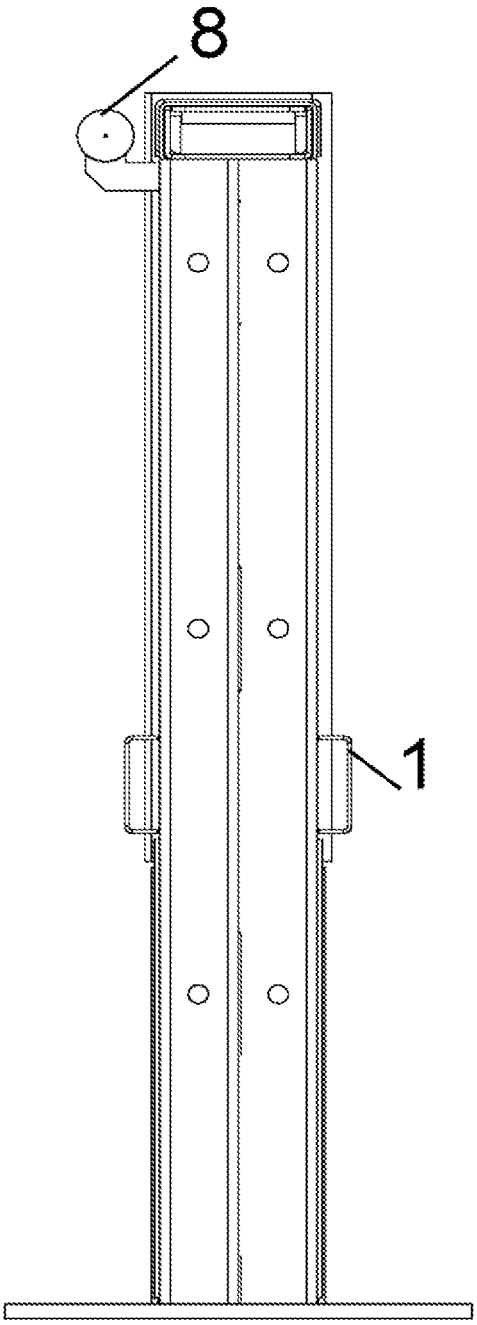
Figures 18, 18A, 18B, 18C, 18D, 19:
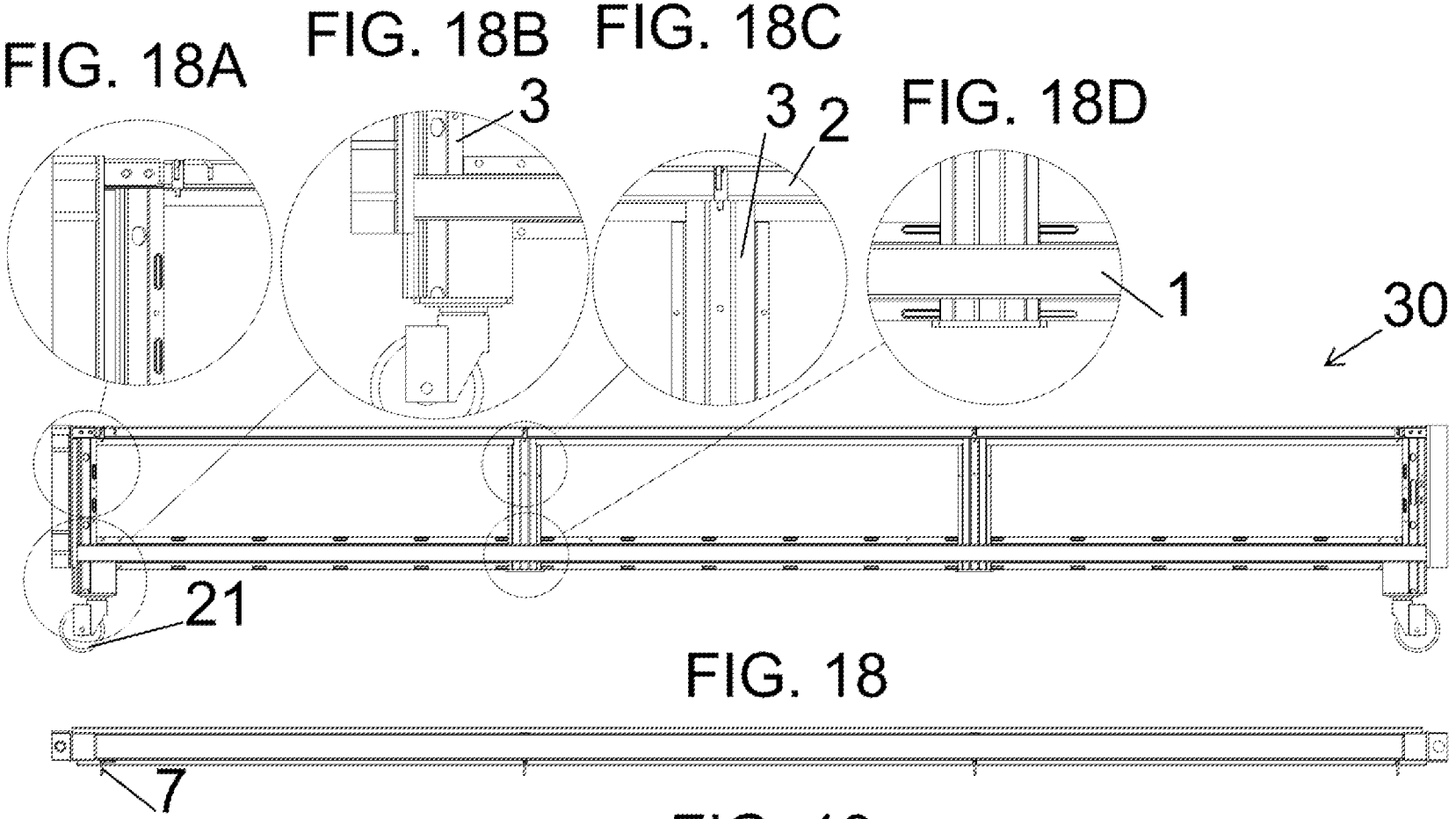
Figure 20:
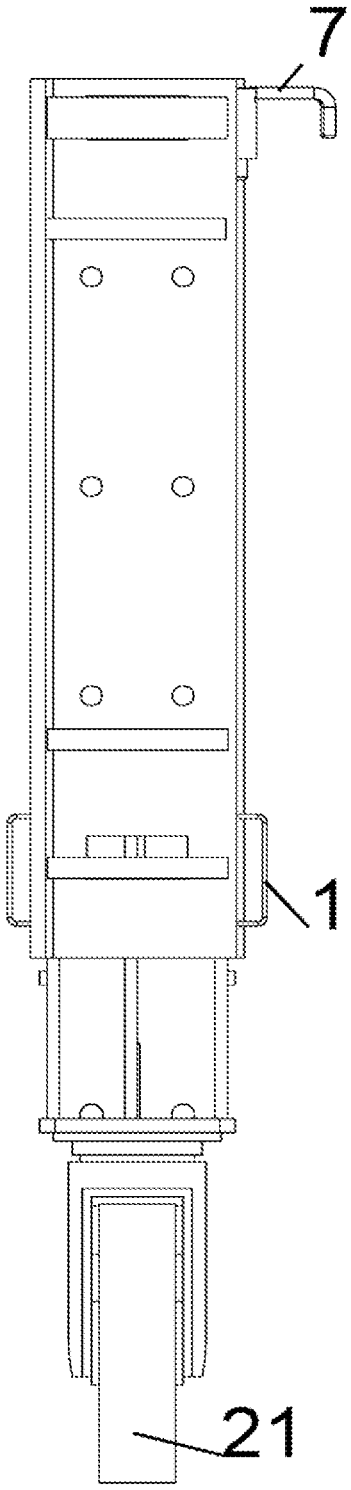
Figure 21:
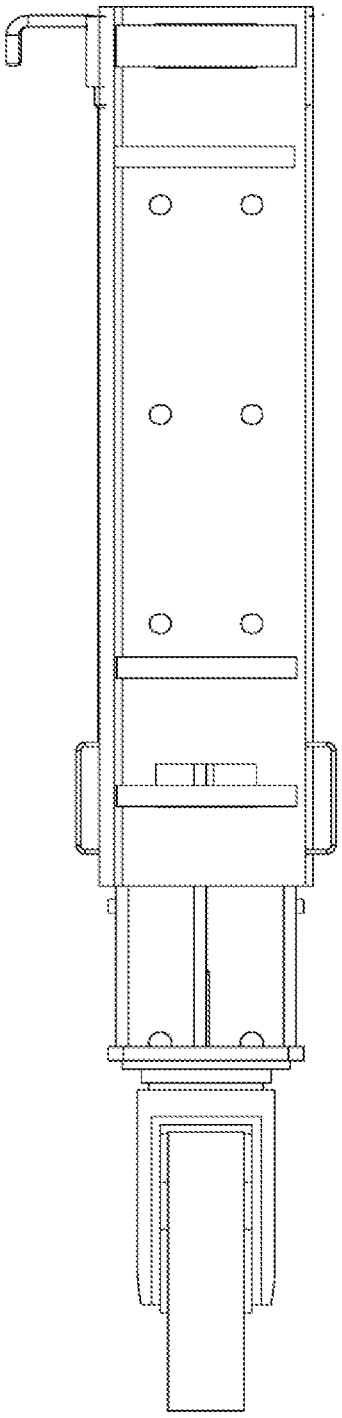
Figures 22, 22A, 22B, 23, 23A, 23B:
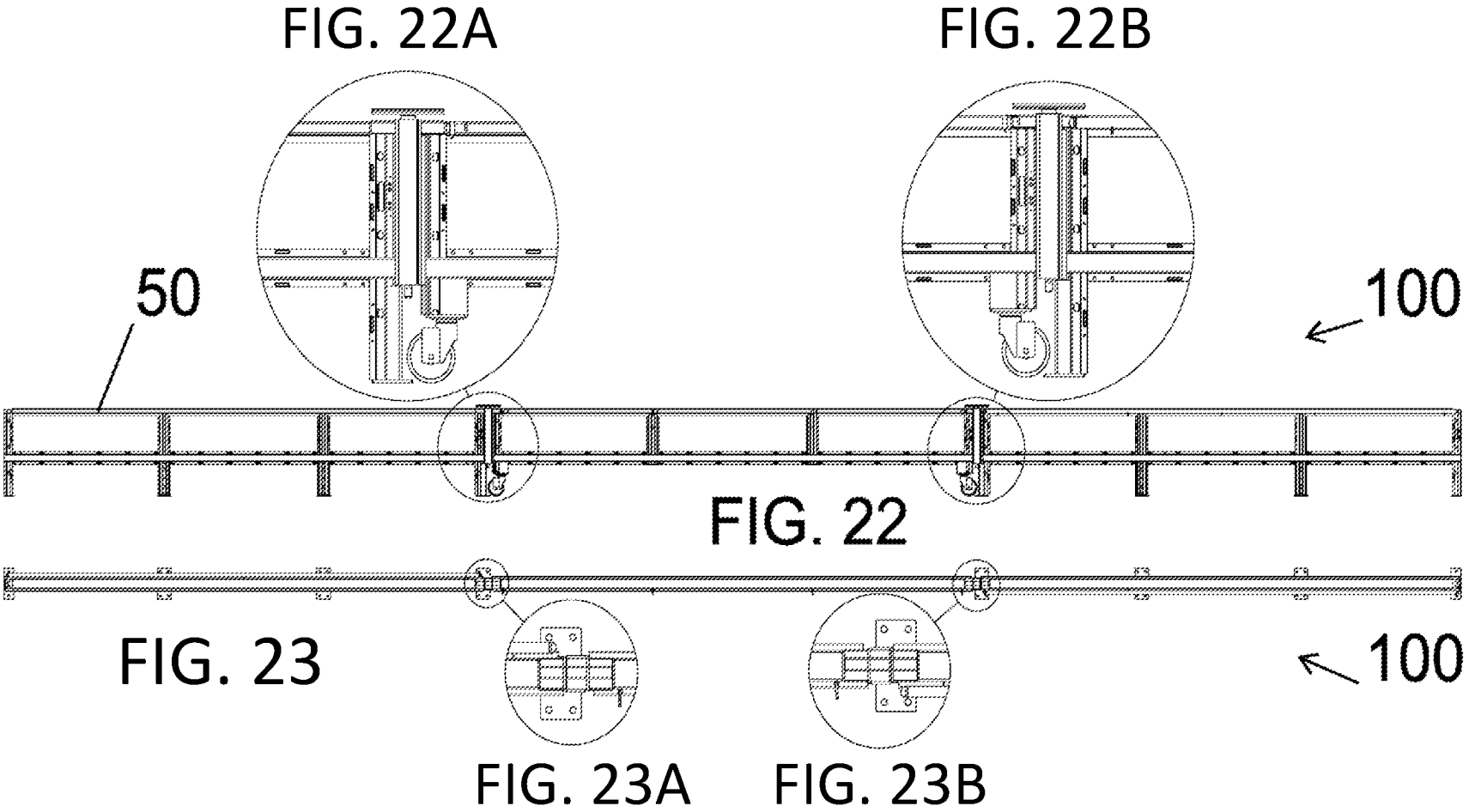
Figure 24:
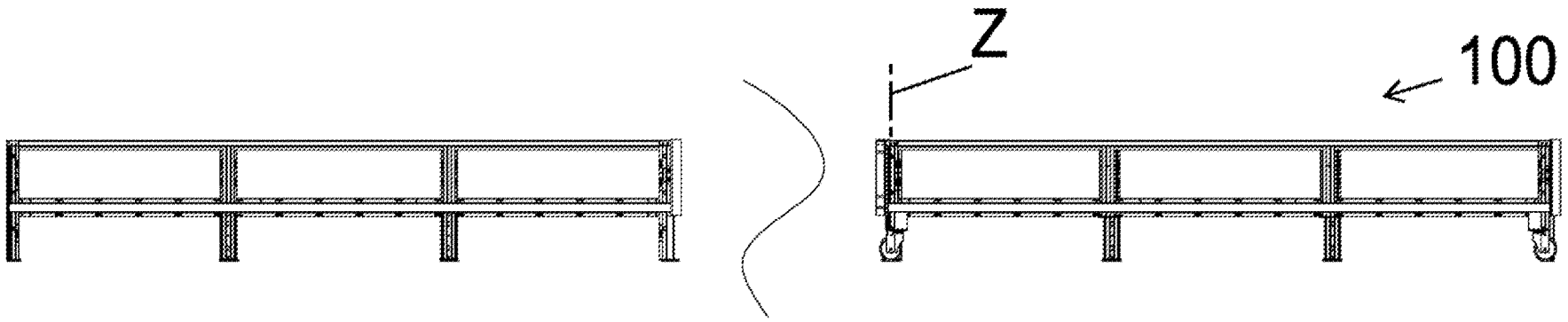
Figure 25:
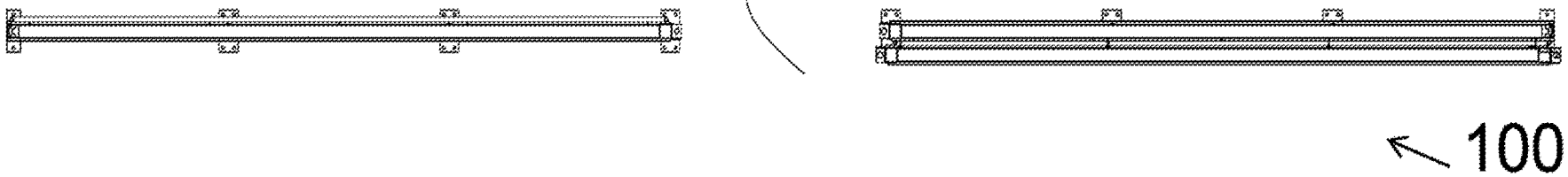
Figure 26:
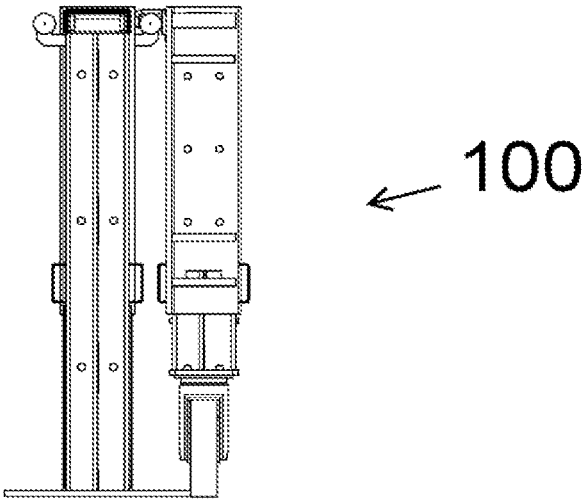
Figure 27:
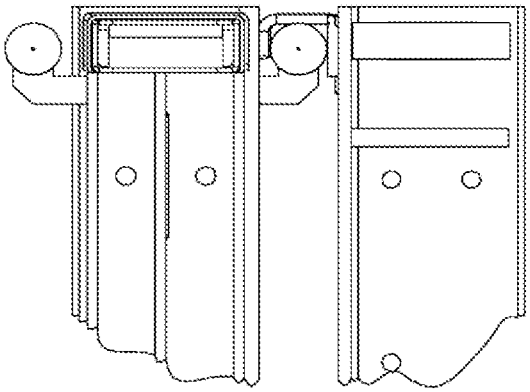
Figures 28A, 28B, 28C, 28D, 28E:
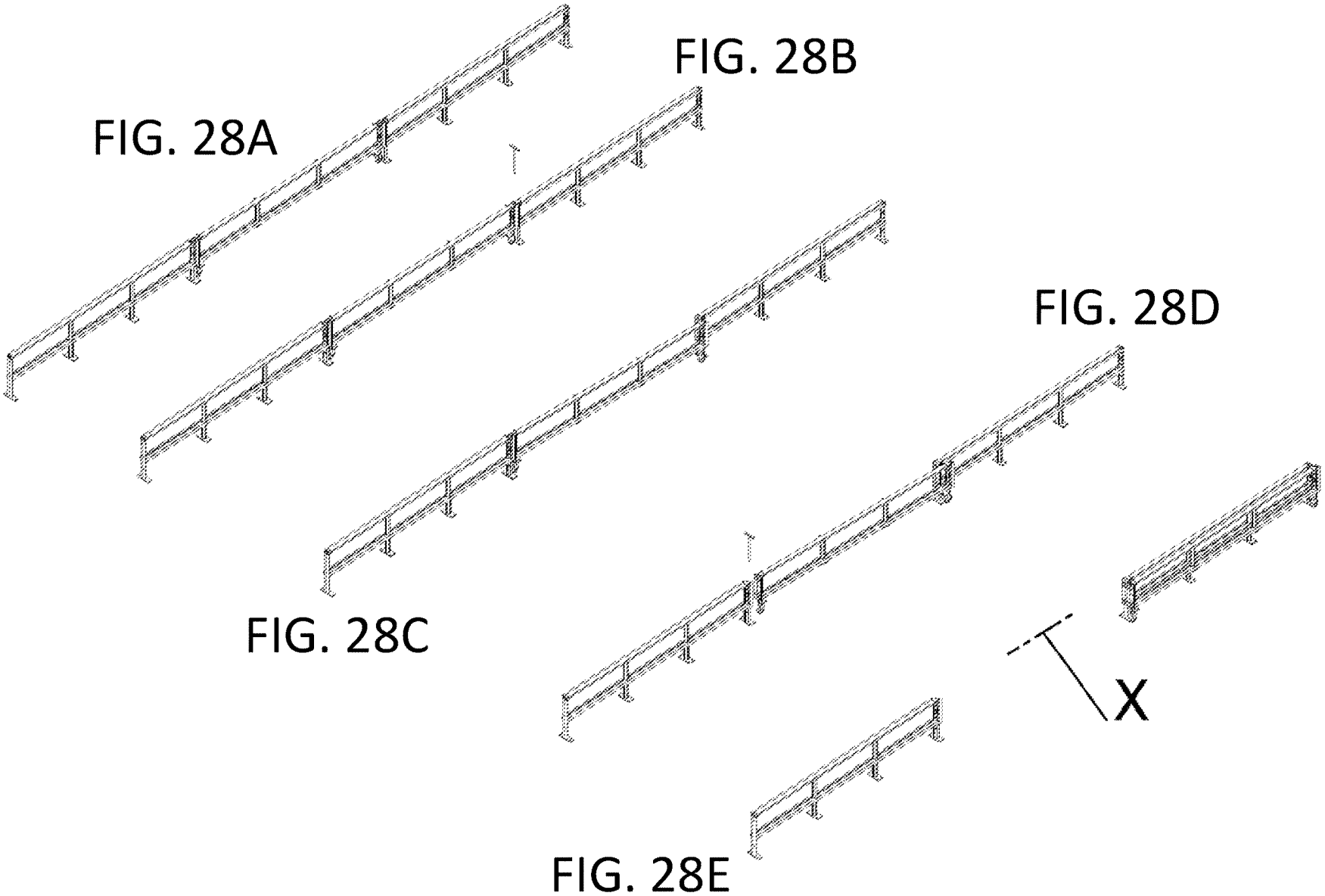
Figure 29:
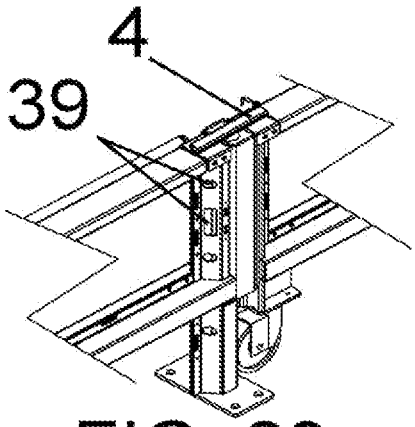
Figure 30:
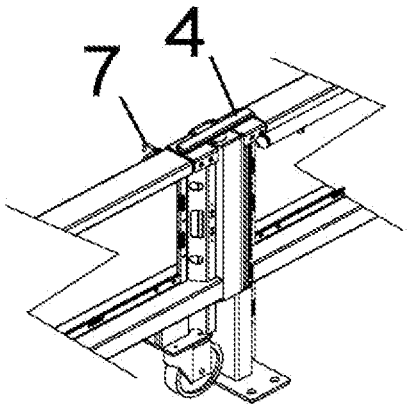
Figure 31:
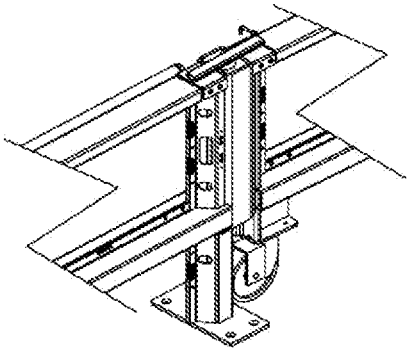
Figure 32:
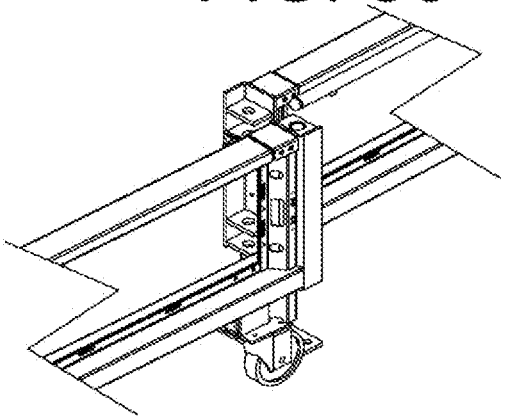

FIG. 14 is a lateral view of an embodiment of a first module of the invention;

FIG. 15 is a view from above of FIG. 14;

FIG. 16 is a view from the left of FIG. 14;

FIG. 17 is a view from the right of FIG. 14;

FIG. 18 is a lateral view of an embodiment of an openable passage module according to a further connected invention, and FIGS. 18A-18D are enlarged views of the indicated areas in FIG. 18;

FIG. 19 is a view from above of FIG. 18;

FIG. 20 is a view from the left of FIG. 18;

FIG. 21 is a view from the right of FIG. 18;

FIG. 22 is a lateral view of an embodiment of a barrier of the invention comprising a first module, an openable passage module and a second module in closed condition of the openable passage, and FIGS. 22A and 22B are enlarged views of the indicated areas in FIG. 22;

FIG. 23 is a view from above of FIG. 22, and FIGS. 23A and 23B are enlarged views of the indicated areas in FIG. 23;

FIG. 24 illustrates a lateral view of the embodiment of the barrier of FIG. 22 in the open condition of the openable passage, in which the space between the first module and the second module has been reduced in the illustration;

FIG. 25 is a view from above of FIG. 24;

FIG. 26 is a view from the left of FIG. 24;

FIG. 27 shows a larger-scale detail of FIG. 26;

FIGS. 28A-28E show an opening sequence of the openable passage of an embodiment of the barrier;

FIG. 29 and FIG. 30 illustrate larger-scale details of the first step of FIG. 28A;

FIG. 31 and FIG. 32 illustrate larger-scale details of the third step of FIG. 28C.

DESCRIPTION OF THE PREFERRED EMBODIMENTS

With reference to the appended drawings, reference numeral 100 denotes a road safety barrier for contacting and redirecting an errant vehicle.

An embodiment of a module (10, 20, 40, 50) of the road safety barrier (100) for contacting and redirecting an errant vehicle according to the invention comprises a first beam (1), a second beam (2) and uprights (3).

Figures 3, 3A, 3B, 3C, 3D:
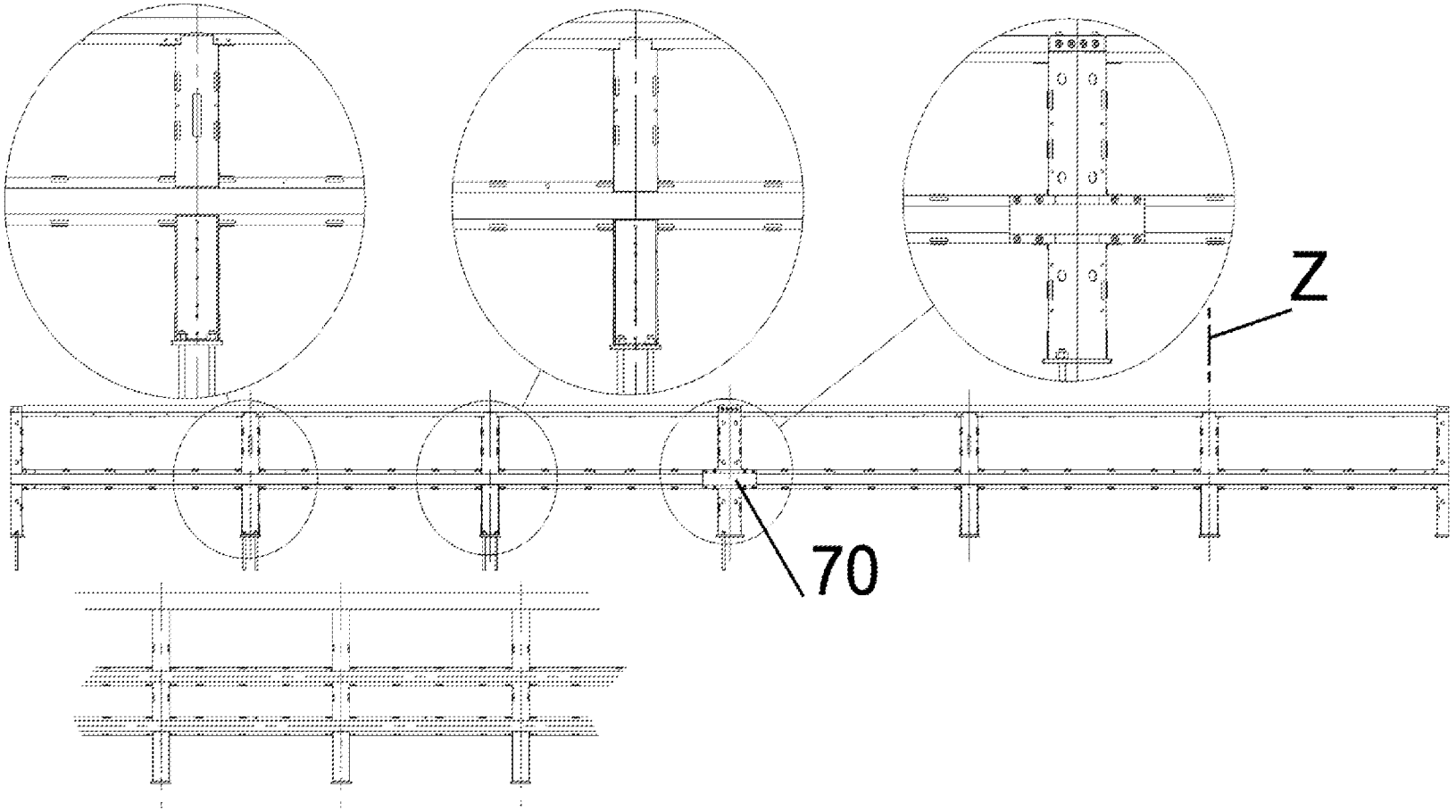
FIG. 3 is a lateral view of the barrier of FIG. 2 when installed.
FIGS. 3A-3C are enlarged views of the indicated areas in FIG. 3.
FIG. 3D is a detail depicting how the teachings are directly applicable to modules of different classes or characteristics.

The module (10, 20, 40, 50) represented in the accompanying figures can be for example in class H2 and comprises only a first beam (1) between the ground and the second beam (2). The module (10, 20, 40, 50) can comprise further beams between the ground and the second beam (2), and generally comprises a third beam in the event it is in class H4. FIG. 3D, in the detail on the left at the bottom, affords an appreciation of how the teachings are directly applicable to modules of different classes or characteristics.

The uprights (3) support the first beam (1) and the second beam (2) and each upright comprises a lower end which is configured to be fixed to the ground and an upper end, opposite the lower end.

Figure 7:
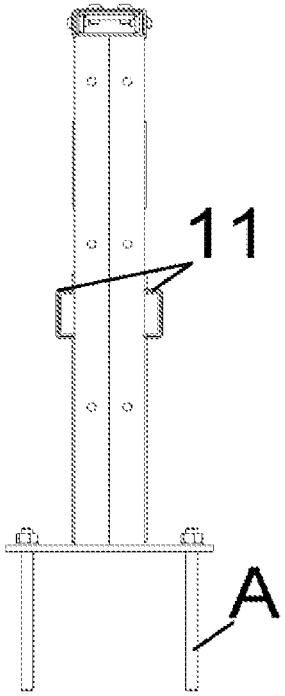
FIG. 7 is a view from the left of FIG. 3.
Figure 8:
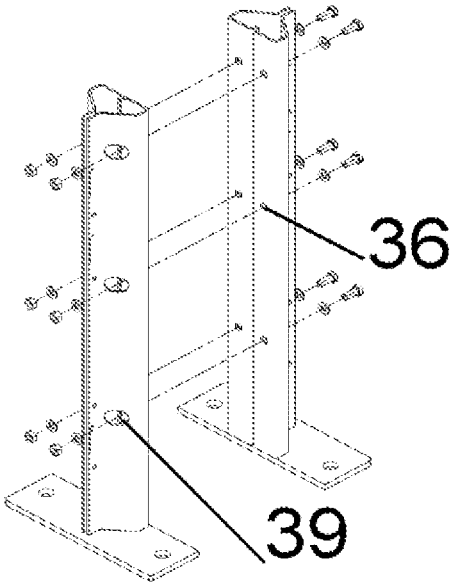
FIG. 8 is an exploded axonometric view of two uprights according to FIG. 6.

As is known to the expert in the sector, the modes of fixing a module (10, 20, 40, 50) of a barrier (100) to the ground vary according to the type of installation. For example the upright can be lodged in the ground or secured to a structure, such as a concrete plinth or a bridge. In the accompanying figures, the uprights (3) comprise holed terminal plates which can accommodate pins or threaded elements, such as for example the stud (A) of FIG. 7. The figure illustrates the studs (A) hypothetically lodged in the ground and engage the holed terminal plates which, in the version herein illustrated, are perpendicular, i.e. horizontal, with respect to the vertical extension direction (Z) of the upright.

The second beam (2) is joined to the upper ends of the uprights (3). The second beam (2) is preferably joined to the upper ends by means of joints of a permanent type, more preferably welds (9) or brazing.

The first beam (1) extends longitudinally from a first upright (31) to a second upright (32) in order to contact and redirect an errant vehicle and is joined between the lower ends and the upper ends, detached therefrom. In other words the first beam (1) is located at respective vertical distances from the lower ends and from the upper ends, i.e. calculated according to a vertical direction.

The first upright (31) and the second upright (32) are preferably at the longitudinal ends of the module (10, 20, 40, 50) and the first beam (1) and the second beam (2) terminate at the first upright (31) and the second upright (32). Owing to this configuration, downstream of the installation, the loads between the modules (10, 20, 40, 50) are transferred by exploiting the uprights (3), thus reducing the deformation of the first beam (1) or the second beam (2).

Figures 1, 1A, 1B:
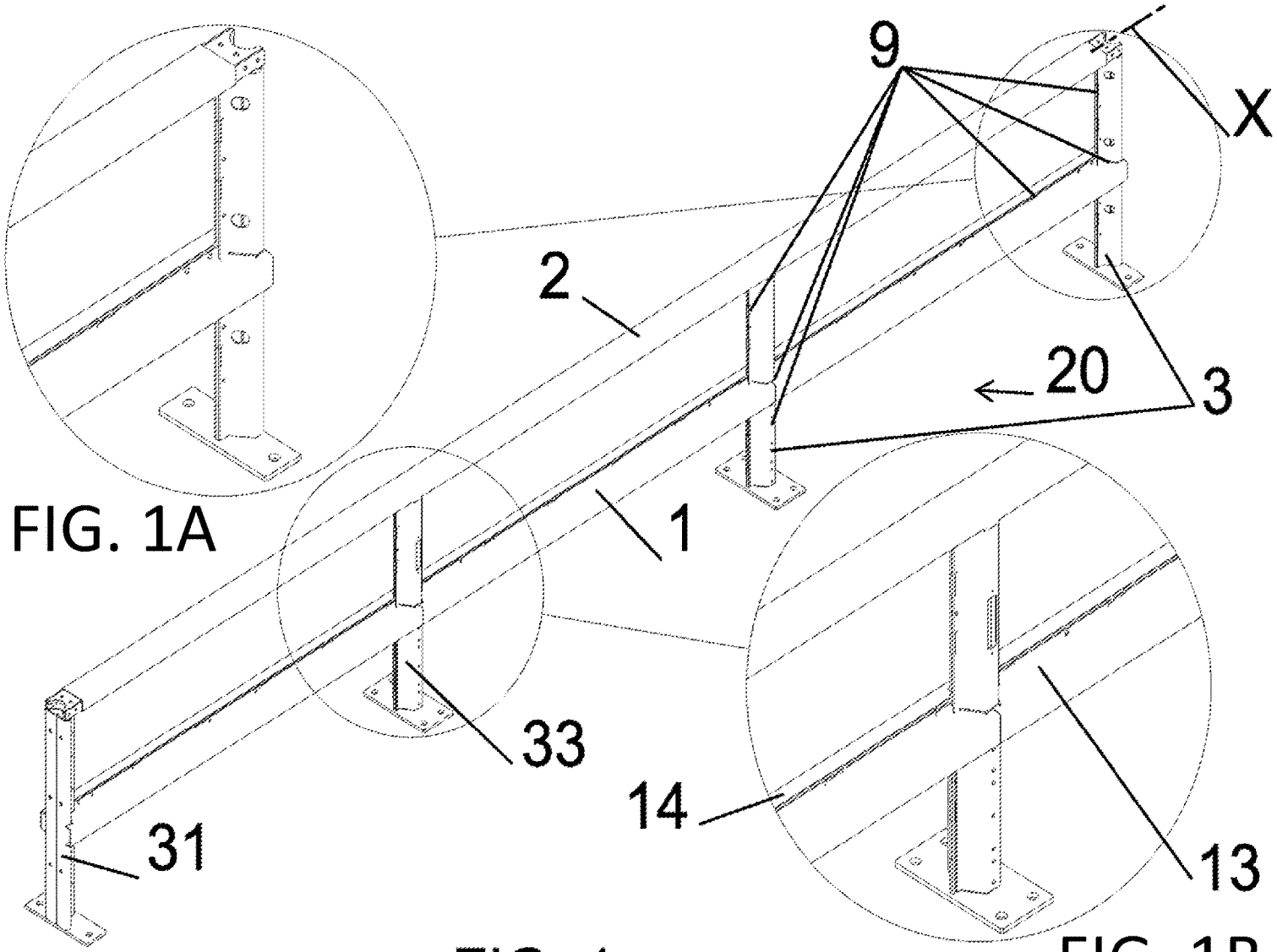
FIG. 1 is an axonometric view of an embodiment of a module of the invention.
FIGS. 1A and 1B are enlarged views of the indicated areas in FIG. 1.
Figures 2, 2A:
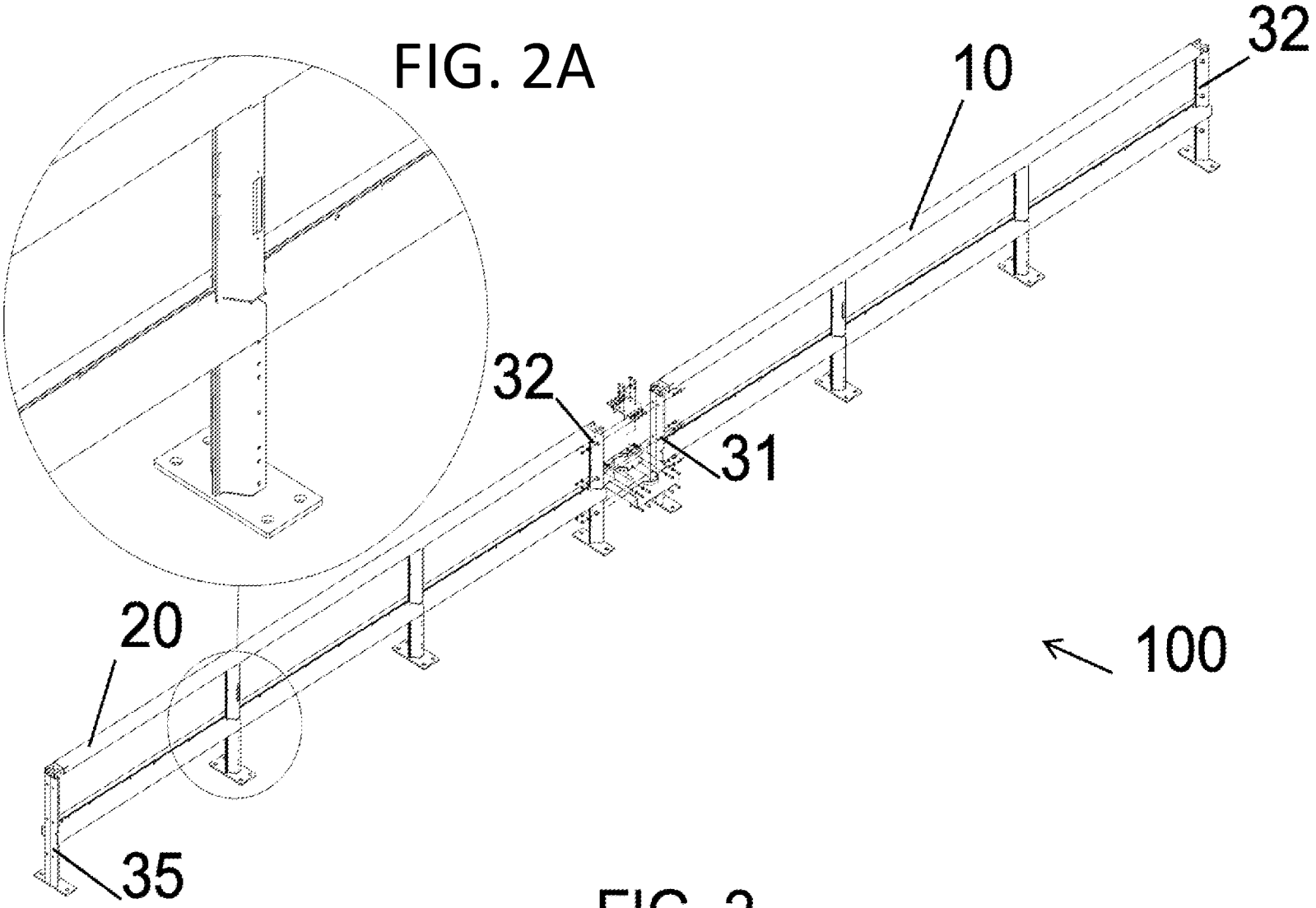
FIG. 2 is an exploded axonometric view of a barrier comprising a first module and a second module according to FIG. 1 and connecting elements.
FIG. 2A is an enlarged view of the indicated area in FIG. 2.

As visible in the embodiment of FIG. 1, the beam is preferably substantially horizontal or is horizontal, i.e. perpendicular to the uprights (3). It is detached from and interposed between the lower and upper ends of the uprights (3); in a case where it is horizontal with a constant section, the lower surface thereof is always spaced at a same distance from the holed terminal plates of the uprights (3) the upper surface thereof is always spaced at a same distance from the second beam (2).

Further, the first beam (1) comprises a first longitudinal part (13) which projects laterally with respect to the uprights (3).

The first beam (1) advantageously comprises a second longitudinal part (14) which projects laterally with respect to the uprights (3), on the opposite side of the uprights (3) with respect to the first longitudinal part (13). The first longitudinal part (13) and the second longitudinal part (14) are both joined to the first upright (31) and to the second upright (32) by means of joints of a permanent type, preferably welds (9) or brazing. The first longitudinal part (13) and the second longitudinal part (14) are joined to one another so as to form a hollow beam by means of welds (9) or brazing, with longitudinally spaced points, i.e. along the length of the first longitudinal part (13) and the second longitudinal part (14). The welds (9) or brazing are longitudinally spaced so as to form longitudinal slots between the first longitudinal part (13) and the second longitudinal part (14). Each longitudinal slot, as can be observed for example in FIG. 1 and FIG. 3, extends between two welds (9) or brazing longitudinally spaced. In other words the welds (9) or brazing directly join the first longitudinal part (13) and the second longitudinal part (14) and two successive weld or brazing points are interrupted by longitudinal slots.

Here and in the rest of this document, "hollow" is taken to mean internally hollow elements, i.e. a tubular element, though the external surface of the tubular element can be provided with slots as described in the following.

The presence of a first longitudinal part (13) and a second longitudinal part (14), especially of the type more fully described in the following, increases resistance to torsion in the first beam (1) while maintaining a good level of deformability and ability to transfer the load longitudinally.

Generally the first longitudinal part (13) and the second longitudinal part (14), extends longitudinally from a first upright (31) to a second upright (32) in order to contact and redirect an errant vehicle, including when the module (10, 20, 40, 50) comprises intermediate uprights (33).

As visible in FIG. 9, the first longitudinal part (13), as well as the second longitudinal part (14), more preferably maintain the C-shaped section, or another appropriate conformation, including in proximity of the uprights (3).

The second beam (2) is also preferably hollow. The second beam (2) more preferably comprises a central body which is constituted by a single part with an open section, i.e. having a slot facing towards the lower ends. FIG. 13 affords an explanatory view of a preferred section of the second beam (2).

The second beam (2), more preferably all the beams of the module (10, 20, 40, 50), preferably extends longitudinally from a first upright (31) to a second upright (32) in order to contact an errant vehicle, redirect or direct or guide it elsewhere. In the contact, the errant vehicle transfers part of its energy, or quantity of motion, to the first beam (1) and, possibly, to the other beams. The beam or beams tend to transfer the impact longitudinally and generally are subject to deflections towards the opposite side, tending to extract the uprights (3) from the ground.

As can be seen in the embodiments illustrated in the accompanying figures, the first beam (1) is substantially continuous over the whole longitudinal extension of the module (10, 20, 40, 50), i.e. it defines an external surface for contacting and redirecting an errant vehicle in a continuous way, with no interruptions. As visible in FIG. 9, the first beam (1) can be made by joining a plurality of profiled members and the continuity in the joints might be only of a functional type. In other words the profiled members might be slightly detached from one another in the longitudinal direction (X).

The same considerations are also generally valid for the other beams of the module (10, 20, 40, 50), especially when they comprise longitudinal parts projecting with respect to the module (10, 20, 40, 50).

Figure 10:
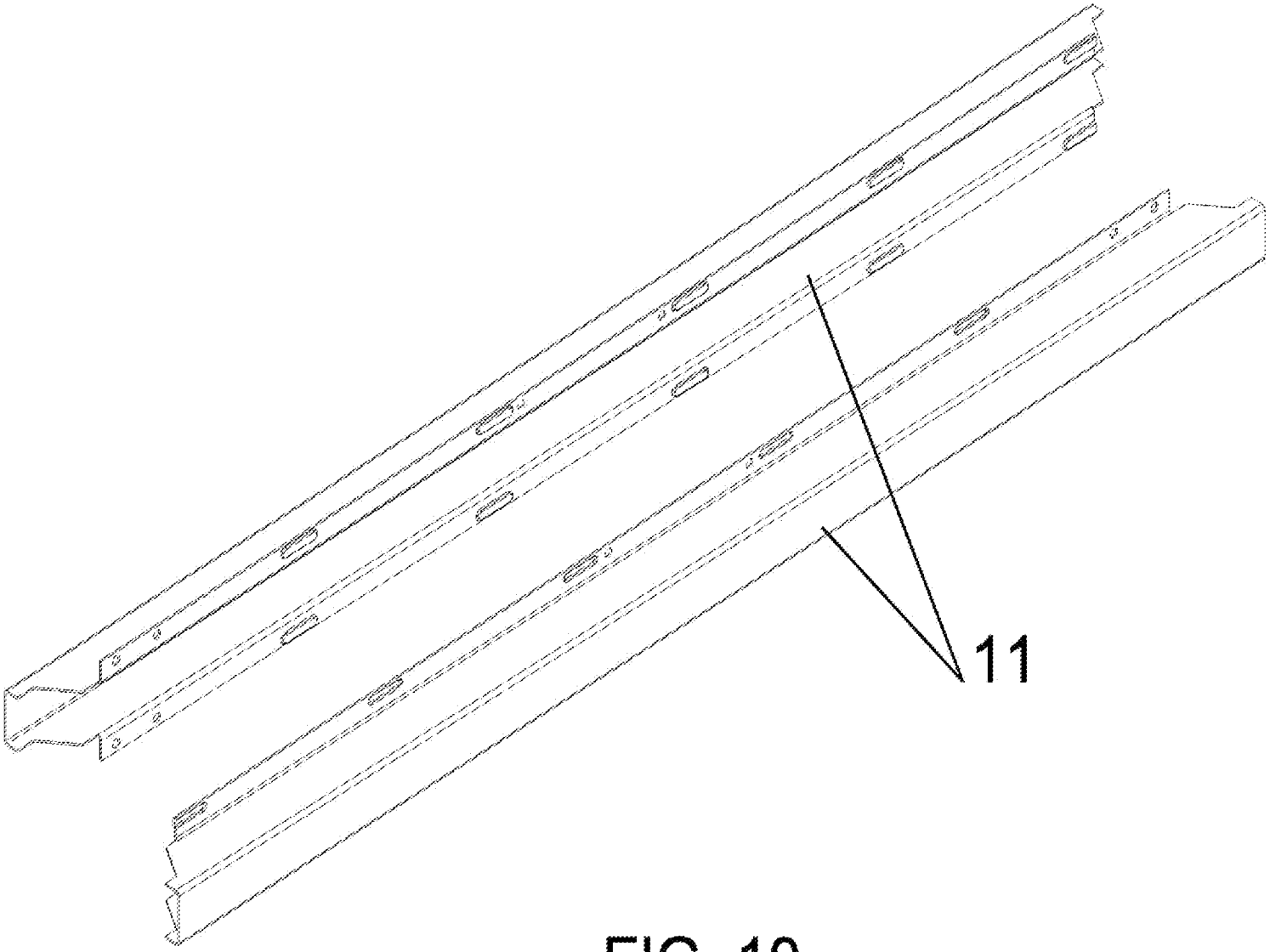
FIG. 10 is an axonometric view of two profiled members of FIG. 9.

The longitudinally spaced welds (9) or brazing preferably directly join the upper ends and lower ends of the first longitudinal part (13) and the second longitudinal part (14) to one another, as illustrated by way of example in FIG. 10 or FIG. 14, where the longitudinal slots facing upwards and downwards can be observed.

The transversal thickness of the longitudinal slots is usually identical or substantially identical to the thickness of the welds (9) or brazing between the first longitudinal part (13) and the second longitudinal part (14).

The uprights (3) are preferably configured to be perpendicular to the ground rest wherein the first longitudinal part (13) and the second longitudinal part (14) are symmetrical with respect to a longitudinal plane passing through the centre lines of the uprights (3).

This configuration enables reducing the transmission of the momentum onto the uprights (3) which is instead important when the first longitudinal part (13) and/or the second longitudinal part (14) is mounted in a cantilever fashion.

The first longitudinal part (13) and the second longitudinal part (14) are preferably both a profiled member having an omega-shaped section (0) and are joined to one another by welds (9) or brazing at both ends of the omega; more preferably by welds (9).

The module (10, 20, 40, 50) preferably comprises at least two intermediate uprights (33) between the first upright (31) and the second upright (32); further, the first longitudinal part (13) and the second longitudinal part (14) both comprise pieces of profiled members interposed between the uprights (3), the longitudinal ends of the pieces of profiled member being joined to the uprights (3) by joints of a permanent type and having a profiling that copies the shape of a portion of the upright to which they are joined. Even in this case the joints are preferably made by welds or brazing. The profiling is, for example, visible in FIG. 4 in which the profiling extends in a transversal direction with respect to the longitudinal direction of the first beam (1).

The part of section laterally outermost of the first longitudinal part (13) and the second longitudinal part (14) is preferably C-shaped. More preferably, as mentioned in the foregoing, the laterally outermost part of section covers the uprights (3).

As already discussed, the first beam (1) and the second beam (2) of each module are preferably both hollow. More preferably, each upright (3) is also hollow and the first beam (1), the second beam (2) and each upright (3) comprise intermediate parts that are located between the ends of the respective cavities, which are in communication with the external environment via slots or holes and are configured so as to discharge the liquid of a galvanizing bath. For example the slots in the smallest dimension thereof can be in the order of ten millimetres, for example 6 millimetres. In this way the module (10, 20, 40, 50) can be produced and subjected to treatments in its entirety before being installed.

As can be deduced from the method that follows, the module (10, 20, 40, 50) is preferably produced using galvanized material.

The invention also relates to a method for realising a module (10, 20, 40, 50) of a road safety barrier (100) such as the one described in the foregoing. In an embodiment the method comprises steps of:

- providing a first longitudinal part (13) and a second longitudinal part (14);
- providing a second beam (2);
- providing uprights (3) comprising a lower end which is configured to be fixed to the ground and an upper end, opposite the lower end;
- joining the longitudinal ends of the first longitudinal part (13) and the second longitudinal part (14) to a first upright (31) and to a second upright (32), in a detached position from the lower ends and upper ends, by means of joints of a permanent type;
- joining the second beam (2) to the upper ends of the first upright (31) and the second upright (32);

reciprocally joining the first longitudinal part (13) and the second longitudinal part (14) so as to form a first beam (1), which is hollow, for contacting and redirecting an errant vehicle;

subjecting the module (10, 20, 40, 50) to a galvanizing treatment with the first longitudinal part (13) and the second longitudinal part (14) joined.

The steps of providing a first longitudinal part (13) and a second longitudinal part (14) and joining the longitudinal ends are configured in such a way that both the first longitudinal part (13) and the second longitudinal part (14) project laterally with respect to the uprights (3) on sides that are opposite one another.

This means that the profile or profiles of the first longitudinal part (13) and the second longitudinal part (14) must be selected in such a way as to have a convex section towards the other part, which is sufficiently wide to project laterally with respect to the uprights (3).

During the step of reciprocally joining the first longitudinal part (13) and the second longitudinal part (14) the first longitudinal part (13) and the second longitudinal part (14) are advantageously detached from one another and are joined by welding or brazing at several longitudinally spaced points so as to form longitudinal slots between the first longitudinal part (13) and the second longitudinal part (14).

In other words the welds or brazing processes directly involve the first longitudinal part (13) and the second longitudinal part (14) while they are kept detached. During the step of providing a first longitudinal part (13) and a second longitudinal part (14), the parts are preferably manufactured by sheet metal press-forming.

During the step of providing a first longitudinal part (13) and a second longitudinal part (14), the parts are preferably identical to one another. Further, during the step of joining the longitudinal ends of the first longitudinal part (13) and the second longitudinal part (14), the uprights (3) are arranged to be perpendicular to the ground rest wherein the first longitudinal part (13) and the second longitudinal part (14) are arranged symmetrically with respect to a plane passing through the centre lines of the uprights (3).

The welds (9) or brazing are preferably realised in the upper ends and lower ends of the first longitudinal part (13) and the second longitudinal part (14).

The first longitudinal part (13) and the second longitudinal part (14) are preferably both a profiled member having an omega-shaped section and, during the step of joining the first beam (1), the first longitudinal part (13) and the second longitudinal part (14), the ends of the omega (Ω) are joined to one another at several points.

More preferably:

during the step of providing a second beam (2) a hollow beam is provided comprising a longitudinal slot or holes;

during the step of providing uprights (3) hollow uprights (3) are provided each comprising slots or holes;

the longitudinal slots and, possibly, the holes, are configured so as to discharge the liquid of a galvanizing bath.

In general the step of performing a galvanizing treatment of the module (10, 20, 40, 50) takes place following the steps of joining the longitudinal ends of the first longitudinal part (13) and the second longitudinal part (14), joining the second beam (2) and reciprocally joining the first longitudinal part (13) and the second longitudinal part (14).

As already mentioned in the foregoing, the module (10, 20, 40, 50) of the present invention can be made in the factory, enabling a reduction in terms of installation time, a lesser dependence on atmospheric conditions during the installation and production specifications that are not applicable in the place of installation. This enables an improvement in the quality and variability of the modules (10, 20, 40, 50) beyond that of introducing a more extensive automation of the processes. In this regard the use of welds or brazing also enables a simpler automation of production.

The module (10, 20, 40, 50) and the barrier (100) are preferably conceived to obtain a high level of containment, for example of the H2 or H4 type; this means that the barrier (100) preferably successfully passes an impact test with an automobile at 100 km/h and an impact test with a bus at 70 km/h and/or with a rigid lorry at 65 km/h with impact angles of 20 sexagesimal degrees and with respective masses of 900 kg, 13000 kg and at least 30000 kg.

In the event of adding a beam to the embodiments described herein, for example to pass from a barrier (100) of type H2 to one of H4, the nearest beam to the second beam (2) preferably has a closed profile. This guarantees greater resistance to oppose important aspects which like barrier (100) technologies might be called to resist.

Joints of the permanent type in general, especially welds and brazing, enable better distribution of stresses, for example with respect to a threaded connection which has the tendency to unload at precise points. The weld thus has the tendency to reduce the maximum tensions in single zones and enables the material of the profiled members to work synergically.

In the accompanying figures the invention is applied by way of example to various realisations of a modular barrier (100). The embodiments of the barrier (100) ensure easy and rapid installation and improve the continuity of the barrier (100) and the behaviour thereof with regard to impacts, in particular increasing the cooperation between the adjacent parts of barrier (100) in absorbing the energy transferred following the impact of the vehicle and limiting, including during the impact, projections or discontinuities among the parts of the adjacent barriers (100).

An embodiment of the barrier (100) comprises modules (10, 20), second connecting elements and third connecting elements.

Each module comprises a first upright (31) and a second upright (32) at longitudinal ends thereof.

The barrier (100) preferably also comprises first connecting elements which are configured for connecting the first beam (1) of a first module (10) to the first beam (1) of a second module (20).

The second connecting elements are configured for connecting the second beam (2) of the first module (10) to the second beam (2) of the second module (20).

The third connecting elements are configured for connecting the first upright (31) of the first module (10) to the second upright (32) of the second module (20).

The first connecting elements and the second connecting elements serve to transfer the longitudinal load on the first beam (1) or second beam (2) due to the impact of an errant vehicle from one side to the other of the joint. In fact the first beam (1) and the second beam (2) can be schematised as cables tensioned between the uprights (3) which must transfer a strong longitudinal component. The first connecting elements and the second connecting elements allow transfer of the load between the first beams (1) and the second beams (2) of different modules (10, 20), thus limiting the transfer of the load towards the adjacent uprights (3). For this reason, the first connecting elements and the second connecting elements preferably connect, directly or substantially directly, the first beams (1) and the second beams (2). For example, in the embodiment of FIG. 4 the load passes through the screws.

The above-described effects combine with those produced by the third connecting elements, to attain the aims of the invention.

The modules (10, 20) are advantageously configured so that the first beams (1) and the second beams (2) are, or are substantially, at the same heights from the ground with the modules (10, 20) coupled, with the second beams (2) joined to the uprights (3) at the upper ends thereof.

Both the first upright (31) of the first module (10) and the second upright (32) of the second module (20) comprise a contact part (35) which is configured for contacting the other contact part (35), with the modules (10, 20) coupled. The contact part (35) faces in a longitudinal direction (X), extending in a vertical direction, and comprises through-holes (36) which are configured for accommodating the third connecting elements, with the modules coupled (10, 20). The through-holes (36) are made at least at two different heights from the lower end so as to prevent the joint from opening downstream of an impact. For the same reason the contact part (35) covers a vertical portion and, preferably, connects the lower end and the upper end of the upright (3).

The third connecting elements are configured to compress between them the contact part (35) of the first upright (31) and the contact part (35) of the second upright (32). In this way the stability of the barrier (100) is assured as well as the response to the impact, with the modules (10, 20) coupled.

The holes (39) accelerate the step of installation of the barrier (100), enabling passage and, possibly, screwing-in of the third connecting elements which are, preferably, bolts, but might be screws, rivets or other joining elements.

The first connecting elements preferably comprise a joint cover (70) for connecting the first beam (1) of the first module (10) to the first beam (1) of the second module (20) when the contact parts (35) touch one another and to accommodate internally thereof the first upright (31) and the second upright (32). The joint cover (70) comprises a first shell (71) and a second shell (72) which are configured to be arranged respectively on the first side and on the second side of the barrier (100) as shown, for example, in FIG. 4.

The first connecting elements preferably comprise threaded connecting elements, in the following described by way of example as first bolts (81).

The second connecting elements preferably comprise screws and a C-shaped plate (69) for connecting the second beam (2) of the first module (10) to the second beam (2) of the second module (20) when the contact parts (35) touch one another.

Figure 4:
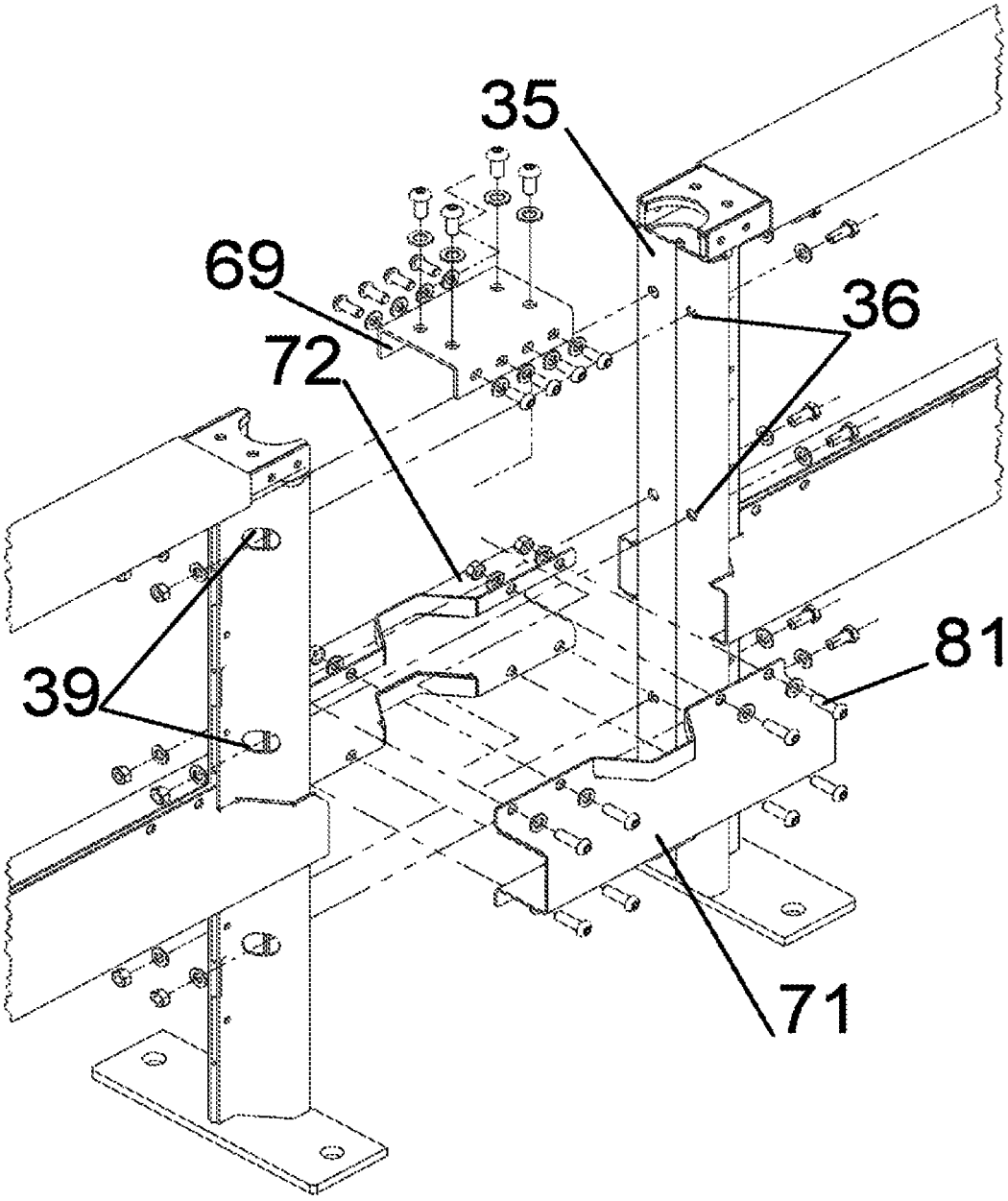
FIG. 4 shows a larger-scale detail of FIG. 2.
Figure 5:
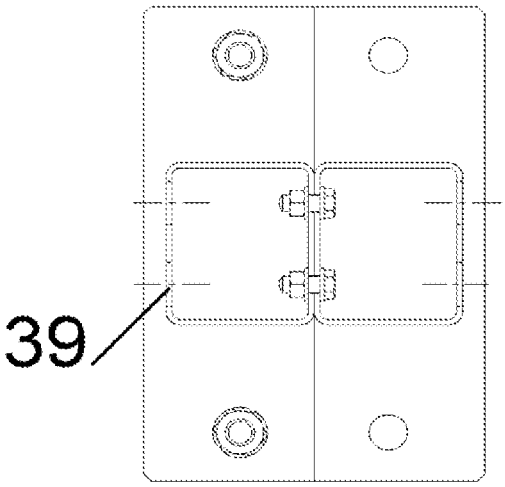
FIG. 5 illustrates a section of a first embodiment of two uprights, placed adjacent and connected.
Figure 6:
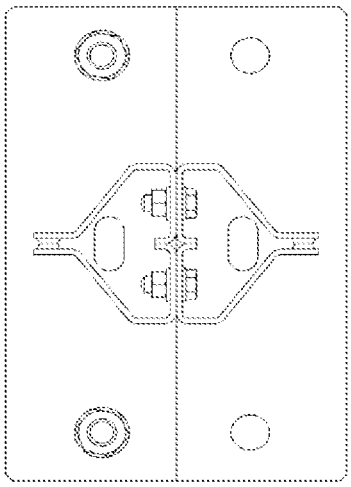
FIG. 6 illustrates a section of a first embodiment of two uprights, placed adjacent and connected.

FIG. 4 enables better observation of the longitudinal slot interrupted by the weld (9) on the first beam (1) to the right and the slots interrupted by welds (9) of the second upright (32). Observing the other accompanying figures it can be understood how the slots and the holes (39) are preferably a plurality for each element or extend for a considerable portion in a longitudinal direction or a vertical direction. Further, at least the slots preferably extend according to a longitudinal direction or a vertical direction, i.e. not in a transversal direction, so as not to significantly reduce the resistance to impact of an errant vehicle.

At least with regard to the first upright (31) and the second upright (32), the same holes (39) can advantageously be used for passage of the third connecting elements.

The presence in the module (10, 20) of hollow elements advantageously allows the passage of cables and flexible elements useful both for integrating the functionality of the barrier (100) and for other unconnected purposes.

The barrier (100) preferably comprises at least a bolt (4) for connecting the modules in a coupling condition.

Another embodiment of the barrier (100) specially adapted for realising an openable passage, for example an emergency openable passage, comprises a passage module (30), usually provided with wheels (21).

In a preferred embodiment, the passage module (30) comprises hooks (7) longitudinally spaced to engage other modules (40, 50) which can comprise suitable slots or a longitudinal guide (8) for accommodating the hooks (7).

The longitudinal guide (8) preferably has a round section to facilitate the sliding of the hooks (7).

The hooks (7) are preferably movable between a rest position, in which they are arranged in a longitudinal direction (X), and a working position, in which they are arranged in a transversal direction. The mobility of the hooks (7) advantageously increases the safety of the barrier (100) in the closed condition of the passage, by preventing any impact or interaction with the vehicles or the people on the road. The two positions assumed by a hook (7) are observable, for example in FIGS. 17, 19 and 21.

It is understood that the above has been described by way of non-limiting example and that any constructional variants are considered to fall within the protective scope of the present technical solution, as claimed in the following.

The invention claimed is:

1. A module of a road safety barrier for contacting and redirecting an errant vehicle, comprising:

a first beam;

a second beam;

uprights that support the first beam and the second beam, each upright comprising a lower end which is configured to be fixed to the ground and an upper end, opposite the lower end; wherein:

the first beam extends longitudinally from a first upright to a second upright in order to contact and redirect an errant vehicle and is joined between the lower ends and the upper ends, detached therefrom;

wherein the second beam is joined to the upper ends;

wherein the first beam comprises a first longitudinal part which projects laterally with respect to the uprights;

the first beam comprises a second longitudinal part which projects laterally with respect to the uprights, on the opposite side of the uprights with respect to the first longitudinal part;

the first longitudinal part and the second longitudinal part are both joined to the first upright and to the second upright by means of joints of a permanent type, wherein the first longitudinal part and the second longitudinal part are joined to one another so as to form an internally hollow beam with welds or brazing, longitudinally spaced so as to form longitudinal slots between the first longitudinal part and the second longitudinal part, each longitudinal slot extending between two welds or brazing longitudinally spaced.

2. The module of claim 1, wherein the longitudinally distanced welds or brazing directly join the upper ends and lower ends of the first longitudinal part and the second longitudinal part to one another.

3. The module of claim 1, wherein the transversal thickness of the longitudinal slots is identical or substantially identical to the thickness of the welds or brazing between the first longitudinal part and the second longitudinal part.

4. The module of claim 1, wherein the joints of a permanent type are welds or brazing.

5. The module of claim 1, wherein the uprights are configured to be perpendicular to the ground rest and wherein the first longitudinal part and the second longitudinal part are symmetrical with respect to a longitudinal plane passing through the centre lines of the uprights.

6. The module of claim 1, wherein the first longitudinal part and the second longitudinal part are both a profiled member having an omega-shaped section and are joined to one another by welds or brazing at both ends of the omega.

7. The module of claim 1, further comprising at least two intermediate uprights between the first upright and the second upright, wherein the first longitudinal part and the second longitudinal part both comprise pieces of profiled members interposed between the uprights, the longitudinal ends of the pieces of the profiled member being joined to the uprights by joints of a permanent type and having a profiling that copies a shape of a portion of the upright to which they are joined.

8. The module of claim 7, wherein the profiling extends in a transversal direction with respect to the longitudinal direction of the first beam.

9. The module of claim 1, wherein the laterally outermost part of section of the first longitudinal part and the second longitudinal part is C-shaped.

10. The module of claim 1 wherein:

the first beam and the second beam terminate at the first upright and the second upright;

the second beam is hollow and is joined to the upper ends by means of joints of a permanent type;

each upright is hollow;

the first beam the second beam and each upright comprise intermediate parts that are located between the ends of the respective cavities and which are in communication with the external environment via slots or holes so as to discharge the liquid of a galvanizing bath.

11. A method for realising a module of a road safety barrier comprising steps of:

providing a first longitudinal part and a second longitudinal part;

providing a second beam;

providing uprights comprising a lower end which is configured to be fixed to the ground and an upper end, opposite the lower end;

joining the longitudinal ends of the first longitudinal part and the second longitudinal part to a first upright and to a second upright, in a detached position from the lower ends and upper ends, by means of joints of a permanent type;

joining the second beam to the upper ends of the first upright and the second upright;

reciprocally joining the first longitudinal part and the second longitudinal part so as to form a first beam, which is hollow, for contacting and redirecting an errant vehicle;

subjecting the module to a galvanizing treatment with the first longitudinal part and the second longitudinal part joined;

wherein the steps of providing a first longitudinal part and a second longitudinal part and joining the longitudinal ends are configured in such a way that both the first longitudinal part and the second longitudinal part project laterally with respect to the uprights on sides that are opposite one another, wherein during the step of reciprocally joining the first longitudinal part and the second longitudinal part, the first longitudinal part and the second longitudinal part are detached from one another and are joined by welding or brazing at several longitudinally spaced points so as to form longitudinal slots between the first longitudinal part and the second longitudinal part.

12. The method of claim 11, wherein the welds or brazing are realised in the upper ends and lower ends of the first longitudinal part and the second longitudinal part.

13. The method of claim 11 wherein:

during the step of providing a first longitudinal part and a second longitudinal part, the parts are identical to one another;

during the step of joining the longitudinal ends of the first longitudinal part and the second longitudinal part, the uprights are arranged to be perpendicular to the ground rest and the first longitudinal part and the second longitudinal part are arranged symmetrically with respect to a plane passing through the centre lines of the uprights.

14. The method of claim 11, wherein the first longitudinal part and the second longitudinal part are both a profiled member having an omega-shaped section and wherein, during the step of reciprocally joining the first longitudinal part and the second longitudinal part, the ends of the omega are joined to one another at several points.

15. The method of claim 11, wherein:

during the step of providing a second beam a hollow beam is provided comprising a longitudinal slot or holes;

during the step of providing uprights hollow uprights are provided each comprising slots or holes;

the longitudinal slots and, possibly, the holes, are configured so as to discharge the liquid of a galvanizing bath.

* * * * *